United States Patent [19]

Liebman

[11] 4,266,759

[45] May 12, 1981

[54] CARDIAC PATIENT SUPPORT

[76] Inventor: Arno J. Liebman, 1819 Shore Dr., Apt. 218, South Pasadena, Fla. 33707

[21] Appl. No.: 87,051

[22] Filed: Oct. 22, 1979

[51] Int. Cl.[3] ..... A61H 31/00

[52] U.S. Cl. ..... 269/323; 269/328

[58] Field of Search ..... 269/328, 323, 325, 326, 269/321 CF; 128/70, 74, 28, 33; 5/433; 108/7, 6, 1; 312/196, 231

[56] References Cited

U.S. PATENT DOCUMENTS

| | | | |
|---|---|---|---|
| 3,565,419 | 2/1971 | Allard et al. | 269/325 |
| 3,800,338 | 4/1974 | Smith | 5/433 X |
| 3,931,653 | 1/1976 | Bien | 5/433 |
| 4,194,732 | 3/1980 | Liebman | 269/323 |

FOREIGN PATENT DOCUMENTS

| | | | |
|---|---|---|---|
| 359856 | 3/1962 | Switzerland | 108/7 |

*Primary Examiner*—Robert C. Watson
*Attorney, Agent, or Firm*—Robert Henderson

[57] ABSTRACT

The cardiac patient support comprises a flat, rigid, horizontal base having an overlying torso support pivotally associated with a lower end area of said base and limitedly adjustable angularly upwardly in relation to the latter to effect and maintain a desired degree of suspension of a patient's head with reference to the patient's torso, with the patient's head extending beyond and clear of the upper end of the torso support. The disclosed means for effecting and maintaining such angular adjustment comprises a chin band and a forehead band, and a pair of manually operable screw knobs working on non-rotatable threaded studs adjacent to the upper end and opposite sides of the torso support. The screw knobs are freely turnable in bearing openings in the torso support. Also disclosed is an adjustable prop for elevating the torso support to hold the patient in a sitting posture; a novel, separable head rest being provided for use when the prop is being employed. An additional disclosed feature is a slidable leg support which can readily be changed from an inoperative position to a position in which it supports a patient's legs.

5 Claims, 8 Drawing Figures

CARDIAC PATIENT SUPPORT

BACKGROUND AND OBJECTS OF THE INVENTION

Beneficial emergency treatment of cardiac patients calls for stimulation of the heart by suitably timed heart massage pressure and by suitably timed injection of air or oxygen into the patient's lungs, sometimes by mouth to mouth activity but, preferably, by pumping of air or oxygen into the patient's lungs. The steps, indeed most emergency remedial help to such patients, is best accomplished if the patient is positioned and restrained on his back upon a suitable cardiac board.

With reference to introduction of air or oxygen into a patient's lungs, the patient's tongue, during an attack, often extends back in the mouth into a blocking position where it dangerously impedes the passage of air through the windpipe. This blocking condition must be effectively remedied before the introduction of air or oxygen and, thereafter during this treatment, the tongue must be caused to remain in a non-blocking condition.

The principal object of this invention is the provision of a cardiac board which elevates the torso of a patient while causing his head to assume and be held in a lowered position relatively to his torso. In such a relation of the torso and head positions, the air passages through the mouth into the lungs become more or less straightened to facilitate the passage of air; and the tongue is easily brought forward to a non-blocking position in the mouth and caused to thus remain. This object is achieved by the screw knob arrangement recited in the foregoing abstract.

Another object is the provision of a cardiac board which additionally has easily operable means for supporting a patient in an approximately upright or sitting position.

Other objects and advantages may be apparent from consideration of the present description and the accompanying drawings.

DETAILED DESCRIPTION

The subject cardiac patient support comprises a flat base 10 upon the lower end of which is fixed a seat 12, to the upper end of which is pivoted a torso support 14.

Figure 1:
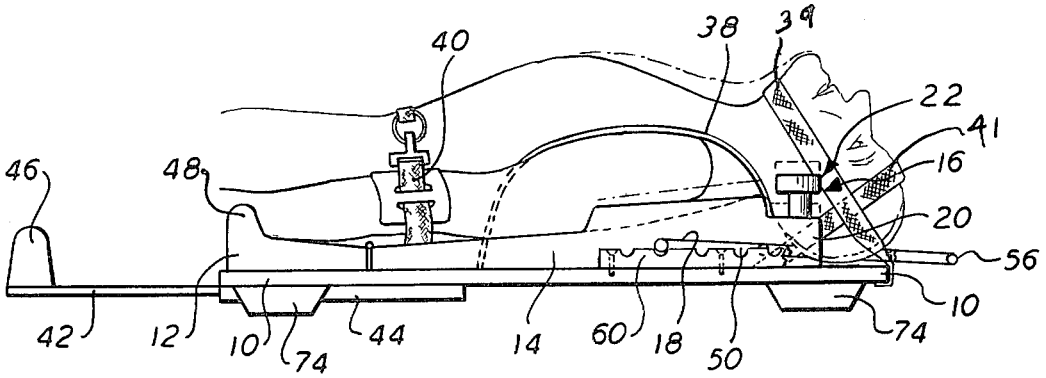
FIG. 1 is a side elevational view of my cardiac patient support, showing the upper portion of a patient resting thereon in condition to permit the adjustment and retention of the patient's head in a desired suspended position in relation to his torso.
Figure 2:
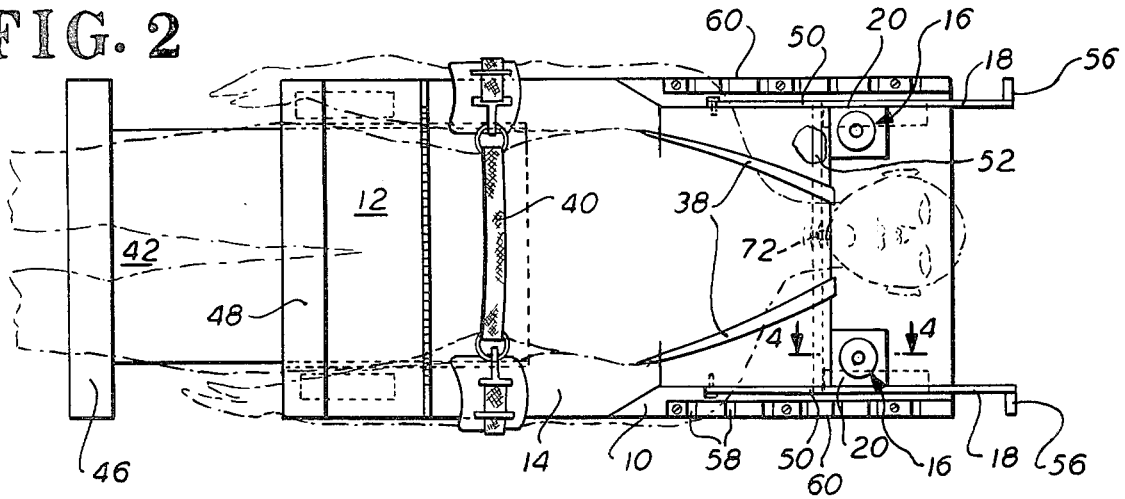
FIG. 2 is a top plan view of the showing of FIG. 1.
Figure 3:
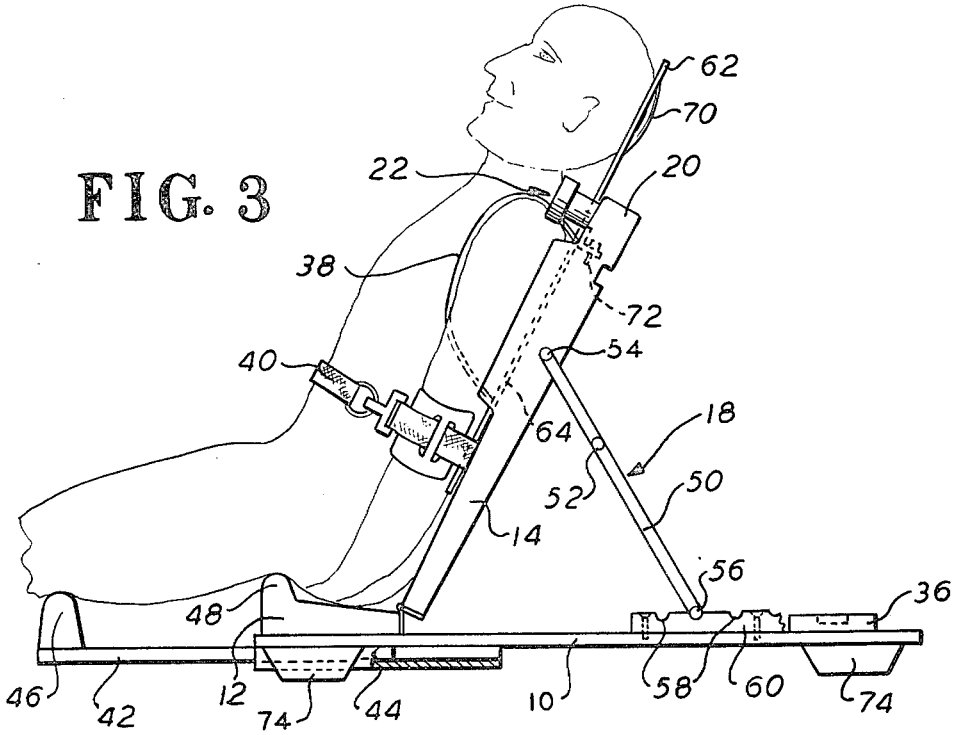
FIG. 3 is a side elevational view of my patient support, showing the device's torso support in a substantially upright position, thus held by a prop to support the patient in a sitting position.

In the principal use of the device, a patient is substantially prone thereon as in FIGS. 1 and 2, and in another use the patient may be supported in a substantially upright position as in FIG. 3.

A screw knob assembly 16, best shown in FIG. 4, serves, as hereinafter explained, to effect limited adjustments in the position of a recumbent patient's torso relatively to his head; and a prop 18 serves to hold a patient substantially upright when desired.

Figure 4:
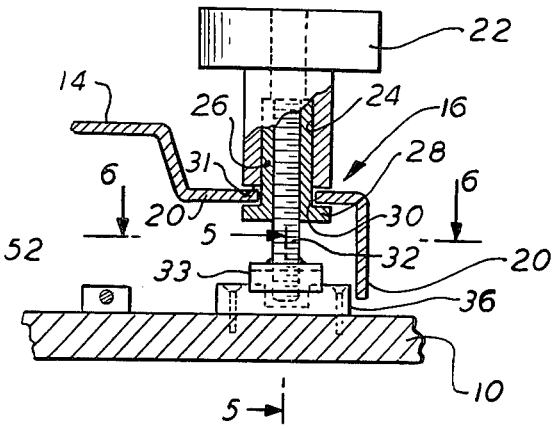
FIG. 4 is an enlarged detail view, substantially on the line 4—4 of FIG. 2, of screw knob means for adjustably elevating the upper end of the torso support.
Figure 6:
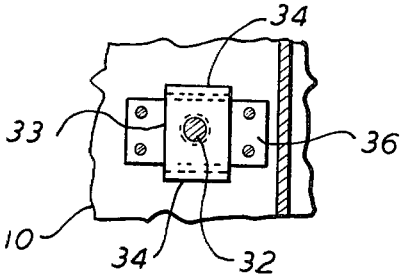
FIG. 6 is a transverse view of said screw knob means substantially on the line 6—6 of FIG. 4.
Figure 5:
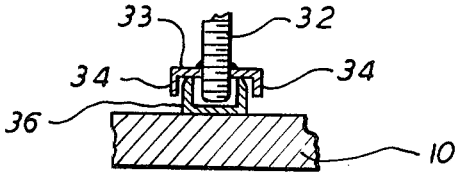
FIG. 5 is an axial view of said screw knob means substantially on the line 5—5 of FIG. 4.

Details of the screw knob assembly 16 are best shown in FIGS. 4, 5, and 6. The components illustrated in FIG. 4 are duplicated at the two points marked 16 in FIG. 2; hence, the following description applies to each assembly of the duplicated components.

The torso support 14 is preferably of reinforced, rigid, relatively thin plastic material, and is generally hollow with the hollow area facing downwardly. The torso support 14 is formed at its upper end corners with integral ears 20 in which the principal components of the screw knob mechanism are operably mounted.

The screw knob assembly 16 comprises a manually operable knob 22 which, for assembly purposes, is formed with a bore 24 opening into its lower end, and an insert 26 adhesively or otherwise suitably fixed into said bore. The insert 26 is formed at its lower end with an annular flange 28, preferably of the same outside diameter as the bottom of the knob 22; and said flange and knob together form an annular recess 30 which loosely receives portions of ear 20 which define a bearing opening 31 in the ear 20 of the torso support 14.

The insert 26 is internally threaded to theadibly receive therein a screw stud 32 which, in operation, is held against rotation by a fixedly integral yoke 33, welded or otherwise suitably fixed to the lower end of said stud; said yoke having side wings 34 which engage opposite sides of a holding strip 36 which is suitably fixed down upon the base 10. Thus, with a web of the ear 20 of the torso support being held between the knob 22 and the insert's flange 28, and the screw stud 32 being held by the holding strip 36 against turning, it follows that manual turning of the knob 22 causes a very gradual raising or lowering of the torso support 14 and, with it, the torso of the patient.

A patient, preferably, is suitably restrained in a recumbent position, as in FIGS. 1 and 2, during introduction of air or oxygen into his lungs. For that purpose, shoulder straps and arm-body straps are employed, as indicated respectively at 38 and 40 in FIGS. 1 and 2. These same straps usually suffice also for holding a patient in an upright position as in FIG. 3.

The disclosed cardiac patient support also includes a retractable support for a patient's thighs: said support being shown as a flat, rectangular board 42, slidable horizontally into or extensible from a sturdy supporting receptacle 44 fixed to the underside of the base 10. The board 42 has a raised, leg supporting cross member 46 fixed upon its outer end. The member 46 may be covered with cushioning material (not shown). The seat 12 has a crosswise raised portion 48 to oppose downward sliding of a seated patient. This portion 48 also may be suitably cushioned. The prop 18 comprises a rigid H-shaped frame having similar opposite side members 50 rigidly interconnected by a cross-member 52. At their upper ends, as viewed in FIG. 3, each side member 50 is pivotally connected, as at 54, to the torso support 14. Each side member 50, at its lower end, is provided with an outwardly projecting lug 56 which may be selectively seated within any one pair of plural pairs of opposed notches 58 of side strips 60 which are suitably fixed upon the base 10, adjacent to the latter's upper end. Thus, the sitting posture of the patient is easily adjusted.

Figure 7:
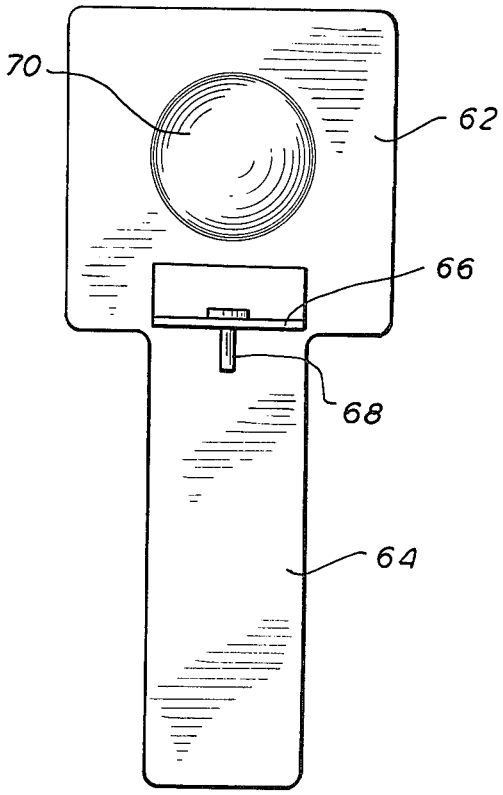
FIG. 7 is an enlarged elevational view of the back of a head support which is useful as a part of my herein described cardiac patient support.
Figure 8:
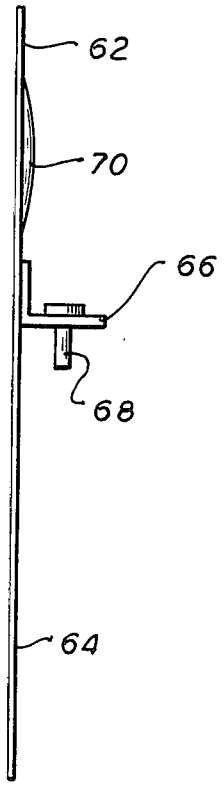
FIG. 8 is an edgewise view of said head support.

The cardiac patient support of this invention may advantageously include a head rest to support the head of a patient sitting approximately upright as in FIG. 3. Such a head rest, illustrated in detail in FIGS. 7 and 8, is formed of relatively thin, rigid sheet material as, for example, plastic material.

The mentioned head rest comprises a generally flat head supporting portion 62 and an integral, depending shoulder tab portion 64. At the juncture of portions 62 and 64 and, at the back of the head rest, is fixed an angle bracket 66 in which is fixed a downwardly directed stud 68, the latter being spaced from the shoulder tab portion 64. The head supporting portion 62 is depressed or dished rearwardly as at 70 to comfortably receive and support the head of a sitting patient as shown in FIG. 3.

FIG. 3 also shows that, in use, the shoulder tab portion 64 is slid down between the patient's shoulders and the underlying torso support 14 thereby, due to the weight of the patient's torso, keeping the head rest well adjusted and adequately held in position relatively to the head and body of the patient. With the head rest thus positioned, the stud 68 extends downwardly into a hole 72, centrally located in the upper end wall of the torso support 14, thereby opposing sidewise dislodgment of the head rest.

The base 10 is preferably provided, on its underside, with feet 74 located at its four corners.

Elaborating somewhat on the adjusting facility of the screw mechanisms 16, and referring particularly to FIG. 1, the torso support 14, in the preliminary condition of the device for dealing with a cardiac emergency, is in a nonelevated position in which a patient's head is yieldably held down by flexible chin and forehead straps 39 and 41 so that, as in full lines, the back of the patient's head either touches or barely clears the base 10. In that situation, the relative angularity of the patient's head and torso may not provide adequately for unblocking a patient's tongue and for a clear passage for pumping air or oxygen through the mouth into the lungs.

To remedy the just mentioned inadequacy, the patient's torso is raised by substantially equal manipulation of the knobs 22 to elevate the upper end of the torso support 14. Thus, the torso is elevated as indicated by broken lines (FIG. 1), while the head, being held down by the straps 39 and 41, rises only slightly, if at all, so that the angularity between the head and torso is increased to provide an improved passageway for air or oxygen to the patient's lungs.

It should be clear that some variations may be made in the features of the present disclosure without, however, departing from the invention as set forth in the accompanying claims.

I claim as my invention:

1. In a cardiac patient support for adjusting the position of a patient's head relatively to his torso; the combination comprising a flat, rigid, horizontal base; a substantially flat, rigid, torso support, said support being capable of directly supporting a patient's torso with the patient's head extending clear of the upper end of said support; a transversely extending hinge connecting the lower end of said support to said base toward the latter's lower end; and elevating means for raising and lowering the upper end of said support relatively to an underlying portion of said base; an improvement in said elevating means comprising similar screw knob assemblies bourn rotatably in opposite end corners of said support, each of said screw knob assemblies comprising a vertically threaded, manually rotatable knob restrained against material axial movement relatively to said support, a screw stud threaded to the threaded portion of said knob and having turn-preventive means at its lower end to oppose turning of said stud; and a holding member fixed upon said base and coacting with said turn-preventive means to oppose turning of said stud when said support is in lowered position, whereby turning of said knob on the non-turning screw stud raises or lowers said support; said turn-preventive means being vertically, slidably disengageable from said holding member to permit raising of the upper end of said support independently of operation of said screw knob assemblies.

2. In a cardiac patient support, the improvement according to claim 1, said holding member comprising a strip, and said turn preventive means comprising a yoke having downwardly extending spaced wings adapted to engage opposite sides of said holding member.

3. In a cardiac patient support, the improvement according to claim 1, each of said knob assemblies comprising upper and lower knob members fixedly telescoped one within the other, said screw stud being threaded to said lower knob member.

4. In a cardiac patient support, the improvement according to claim 1, further including a head support of substantially rigid flat material, having an upper end area dished to receive the back of a patient's head, a lower end portion, integral with said upper end area, extendible between a patient's back and said torso support, and a lug protruding rearwardly and downwardly from an intermediate area of the back of said head support and adapted to engage within a centrally located opening in said torso support; said lower end portion of the head support and said lug serving ro stabilize the position of the head support.

5. In a cardiac patient support, the improvement according to claim 1, further including a flat, rigid leg rest, and a receptacle for said leg rest located at the lower end of and underneath said base; said leg rest being adapted to slide into said receptacle for storage purposes and being slidable outwardly, longitudinally of said base to a leg supporting position.

* * * * *